US007197794B2

(12) United States Patent
Davis et al.

(10) Patent No.: US 7,197,794 B2
(45) Date of Patent: Apr. 3, 2007

(54) MODULAR DRIP TRAY

(75) Inventors: Gerald H. Davis, Fountain City, IN (US); Gary L. Cox, Richmond, IN (US); Chad L. Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 210 days.

(21) Appl. No.: 10/886,135

(22) Filed: Jul. 7, 2004

(65) Prior Publication Data

US 2006/0005364 A1 Jan. 12, 2006

(51) Int. Cl.
*A61G 17/00* (2006.01)

(52) U.S. Cl. ..... 27/19; 27/2

(58) Field of Classification Search ..... 27/19, 27/2, 11, 12; 206/557, 558
See application file for complete search history.

(56) References Cited

U.S. PATENT DOCUMENTS 3,488,818 A * 1/1970 Orr ..... 27/2
3,964,140 A * 6/1976 Gauchard ..... 27/2
4,949,439 A * 8/1990 Semon ..... 27/19
4,951,367 A * 8/1990 Wolfe ..... 27/19
5,092,020 A * 3/1992 MaGuire ..... 27/19
RE33,971 E * 6/1992 Wolfe ..... 27/19
RE34,846 E * 2/1995 McGuire ..... 27/19
5,444,900 A * 8/1995 Shawhan et al. ..... 27/19
5,615,464 A * 4/1997 Rojdev ..... 27/19
6,434,804 B1 * 8/2002 Cornet et al. ..... 27/2
6,877,195 B2 * 4/2005 Guillot ..... 27/2

* cited by examiner

*Primary Examiner*—William L. Miller
(74) *Attorney, Agent, or Firm*—Maginot, Moore & Beck

(57) ABSTRACT

A modular drip tray for use in a casket includes a plurality of modules and an overlapping member. The plurality of modules are placed into a casket adjacent to each other and the overlapping member creates an overlap region that spans a portion of the two modules and any gap between the modules such that liquids impinging upon the overlap region will be impaired from progressing beneath the overlap region. The overlapping member may be formed integrally with one or more modules. Each module may further comprise a plurality of discrete isolated compartments for retention of liquids.

20 Claims, 10 Drawing Sheets

MODULAR DRIP TRAY

FIELD OF THE INVENTION

The present invention relates generally to burial and cremation containers.

BACKGROUND OF THE INVENTION

The embalming process and natural decomposition of human remains results in the generation of viscous fluids. When these fluids are generated in while the human remains are in a burial or cremation container (e.g. casket), the fluids naturally migrate to the lower portions of the casket. This migration may result in a number of problems. Caskets are constructed from a plurality of materials, including wood, metal, and paper materials, as well as combinations of the foregoing. Thus, the caustic nature of the fluids can lead to corrosion of casket materials. Moreover, caskets are subject to leakage.

The problems associated with leakage can be broadly discussed as either short term or long term problems. In the short term, the casket will be subjected to movement, as the casket may be moved between the viewing environment and/or memorial service location and its final resting place, whether that be interred in the ground, cremated, or placed into a mausoleum or crypt. Thus, resolution of the leakage problem must address the fact that the casket will be subjected to movement, such as starts and stops and being tilted. In the short term, however, there is a lesser amount of fluids in the casket. In the long term, the casket is much less likely to be subjected to movement. However, more fluid will be present over the long term.

A variety of means have been developed to reduce the potential of leakage. U.S. Pat. No. Re. 34,846 discloses one such approach. This patent discloses a seamless, one-piece drip tray for a casket with a plurality of discrete isolated compartments for the retention of fluids. Another approach is disclosed in U.S. Pat. No. 5,615,464 wherein a one-piece drip tray designed to be retrofitted into caskets previously fabricated without a drip tray. The drip trays disclosed in these patents are very useful in reducing the potential problems associated with leakage. However, the one-piece design of the drip trays does present various difficulties associated with the fabrication and installation of the drip trays into caskets.

Typically, drip trays are fabricated from a thermoplastic material such as high density polyethylene. The material is generally vacuum formed in an in-line vacuum forming machine. In-line vacuum forming machines are available in a number of sizes. Obviously, as the size of the final product increases, the size of the machine needed to fabricate the product necessarily increases. By way of example, a typical casket is 82 inches long and 27 inches wide, so a one-piece construction drip tray would need to be almost that size. Accordingly, a manufacturer would be required to have an in-line vacuum forming machine with a capacity of at least those dimensions. For a variety of reasons, obtaining and maintaining such a machine capable of fabricating one-piece drip trays for caskets can be uneconomical.

Installation of a one-piece drip tray presents additional problems. Proper installation of the drip tray without damage to the drip tray is critical in minimizing the potential for leakage. Although the drip trays are light-weight, their large dimensions make them unwieldy. For example, a large casket sized drip tray can be difficult to manipulate in the close confines of a casket. Moreover, the drip trays are designed to be structurally sound once installed. However, they can be relatively fragile while being handled, being subject to bending.

There is a need, therefore, for a casket leak containment system that may be fabricated on smaller in-line vacuum machines. It would be beneficial if the leak containment system could be more easily installed into a casket than traditional drip trays. It would be further beneficial if the leak containment system were of a robust design, reducing the potential for damage to the leak containment system during installation. It is desired that the above advantages be realized in a leak containment system that is light-weight, durable, inexpensive to manufacture, and capable of preventing leakage both in short term and long term applications.

SUMMARY OF THE INVENTION

The present invention fulfills the above needs, as well as others, by providing a leak containment system constructed from multiple modules. The modules may be individually formed and installed. When installed, the modules overlap along at least one edge to provide proper leak protection between the modules. The modular design of the drip tray allows for a smaller in-line vacuum machine to be used to produce the individual modules. In the event a module is damaged, there will be less waste than in a one-piece drip tray. Moreover, the reduced size of each module results in greater structural integrity while moving the modules as well as increased ease of installation. However, it will be appreciated that variants of the invention may provide the advantage of ease of manipulation even it provides none of the advantages associated with using a smaller vacuum forming machine. Moreover, variants of the invention may provide some of the advantages associated with using a smaller vacuum forming machine without any advantages associated with ease of manipulation into a casket.

In some embodiments, the modules of the modular drip tray are identical in design. The use of identical modules in a modular drip tray provides a further advantage of reduced tooling and logistical costs.

The above described features and advantages, as well as others, will become more readily apparent to those of ordinary skill in the art by reference to the following detailed description and accompanying drawings.

DETAILED DESCRIPTION

Figure 1:
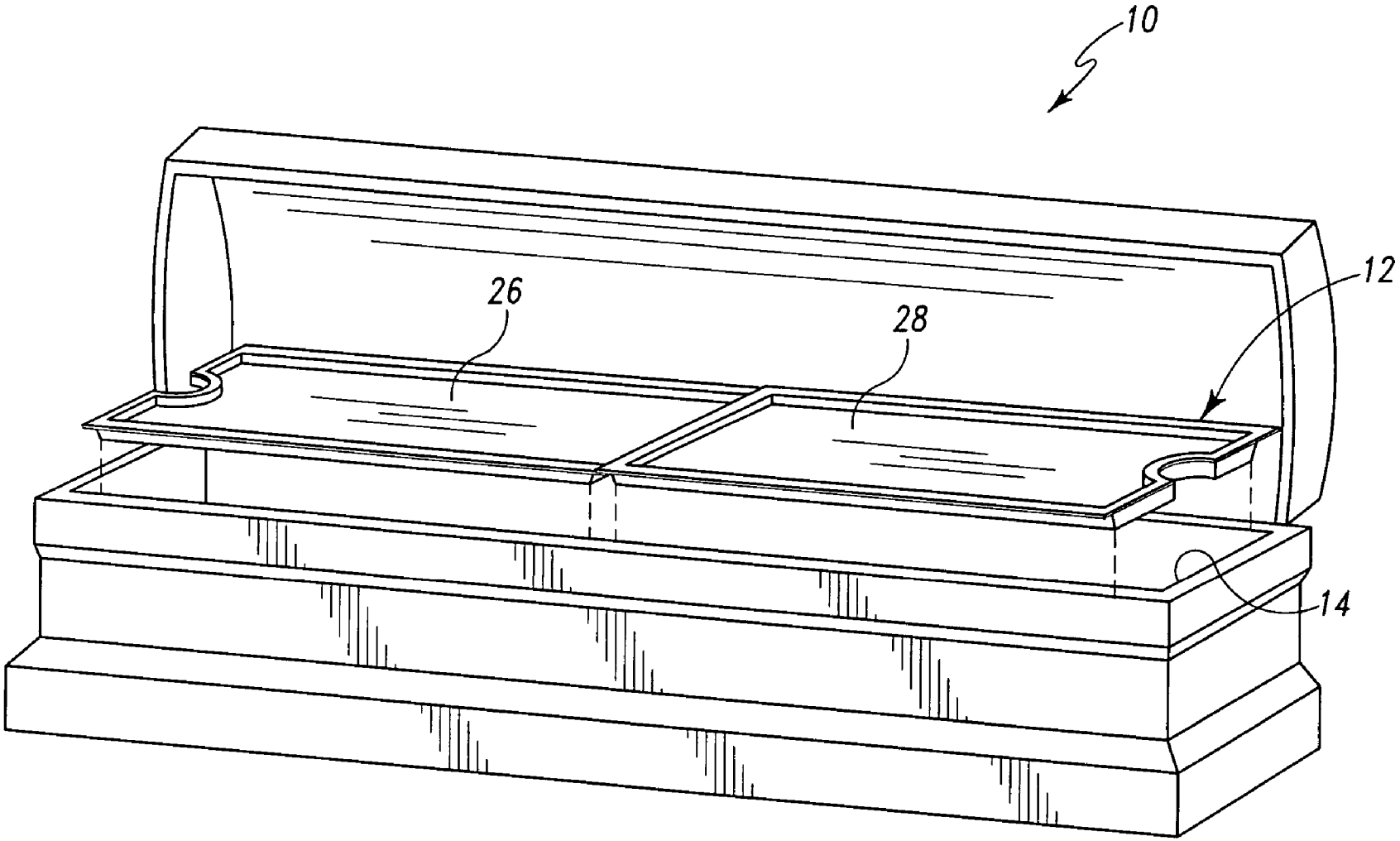
FIG. 1 shows an exploded perspective view of an exemplary embodiment of a modular drip tray assembly in accordance with features of the present invention and a casket.

For the purposes of promoting an understanding of the principles of the invention, reference will now be made to the embodiments illustrated in the drawings and described in the following written description. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
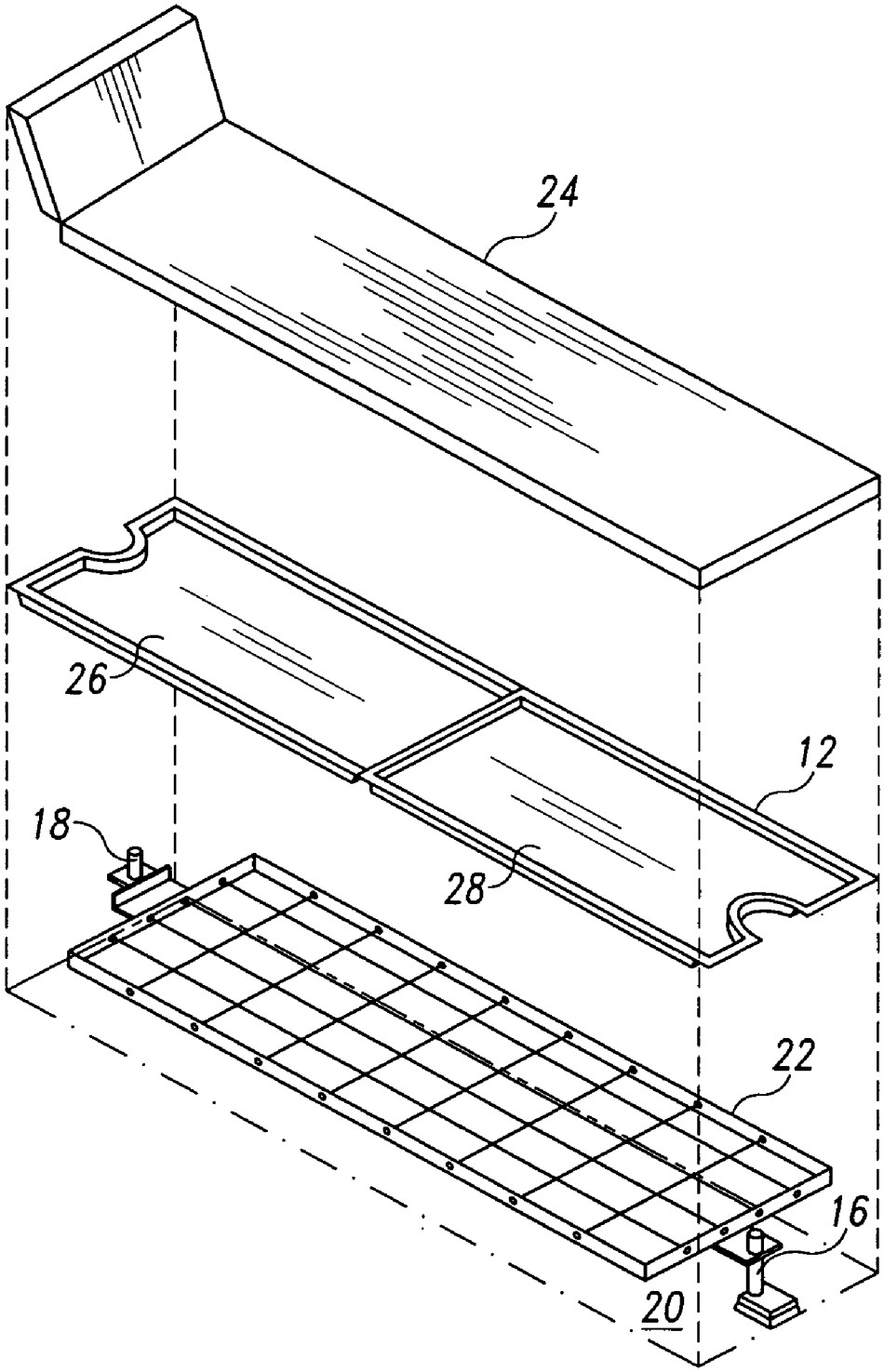
FIG. 2 shows an exploded view of a spring support structure, mattress, and the modular drip tray assembly of FIG. 1.

FIG. 1 shows a casket 10 with a modular drip tray assembly 12 which incorporates features of the present invention. The modular drip tray assembly 12 is configured to fit within the cavity 14 of the casket 10. More specifically, as shown in FIG. 2, the casket 10 includes two bed screws 16 and 18 that are mounted on the bottom 20 of the cavity 14. A spring support structure 22 is mounted on the bed screws 16 and 18. The modular drip tray assembly 12 is placed on top of the spring support structure 22 and a mattress 24 is positioned on top of the modular drip tray assembly 12.

Figure 3A:
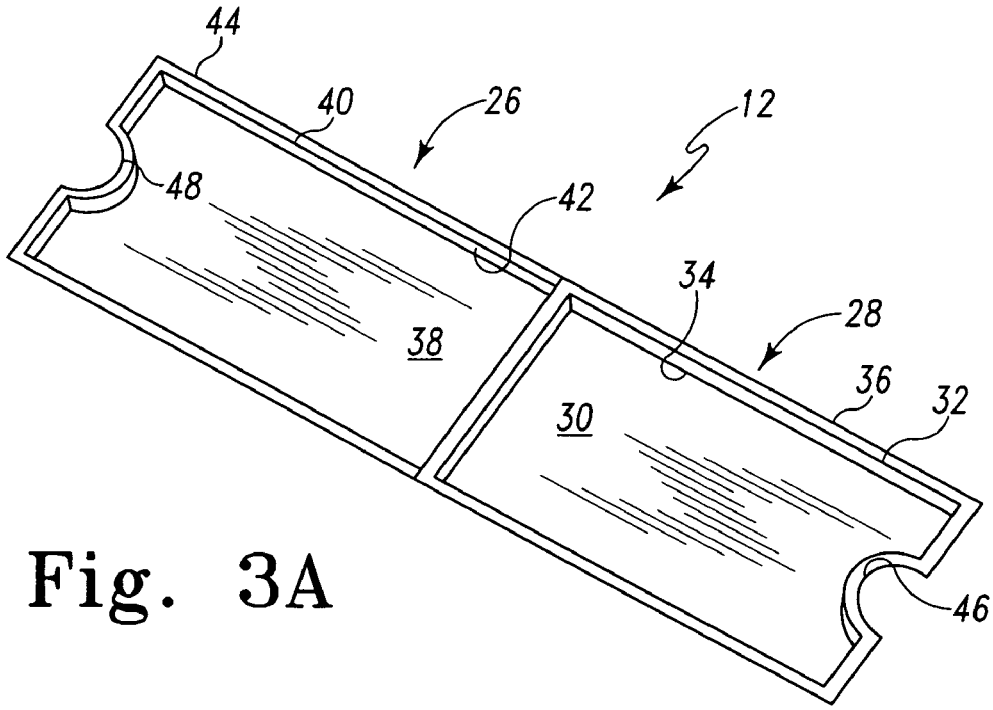
FIG. 3A shows a perspective view of the modular drip tray assembly of FIG. 1.
Figure 3B:
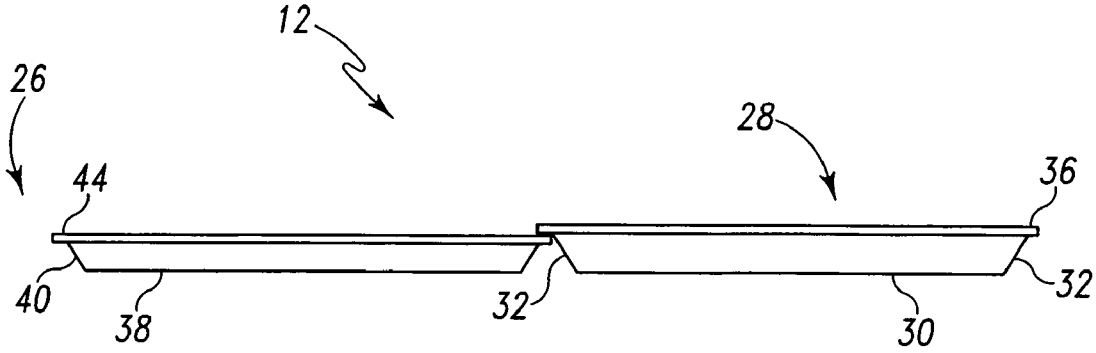
FIG. 3B shows a side elevational view of the modular drip tray assembly of FIG. 1.

With additional reference to FIGS. 3A and 3B, the modular drip tray assembly 12 in this embodiment includes module 26 and module 28. Module 28 includes a bottom 30 and a wall portion 32 that extends upwardly and outwardly from the bottom 30 to define a basin 34. In this embodiment, a rim 36 extends outwardly from the upper end of the wall portion 32, completely around the periphery of module 28. Likewise, the module 26 includes a bottom 38 and a wall portion 40 that extends upwardly and outwardly from the bottom 38 to define a basin 42 and a rim 44 extends completely around the periphery of module 26 from the upper end of the wall portion 40. Both of the wall portions 32 and 40 curve inwardly at one end to form concavities 46 and 48 respectively.

As shown in FIG. 3B, when installed, the rim 36 of the module 28 extends over the top of the rim 44 of the module 26 where the module 28 is adjacent to the module 26. Thus, both the rim 44 and the rim 36 are overlap members and provide an overlap area between the modules 26 and 28. The overlap area substantially reduces the potential for leakage of fluids between the modules 26 and 28.

Each of the modules 26 and 28 is preferably vacuum-formed as a single integrated unit with a thickness suitable for supporting its own form even when an amount of fluid is collected within the basins 34 and 42. It is also preferable to ensure that the thickness is maintained thin enough to avoid excess stiffness since some flexibility is helpful when positioning the modules within a casket. Of course, the two piece construction of modular drip tray assembly 12 has reduced flexibility requirements than that of the larger prior art single piece design. In any event, one suitable embodiment of the invention has a wall thickness of between 0.004 inches and 0.02 inches, preferably about 0.040 inches and is formed from polyethylene. Of course, the necessary thickness of the walls will depend upon a variety of design choices that affect the capability of a formed object to maintain its shape when liquid is being held. Such design choices include, but are not limited to, the presence or absence of a rim, of ribs, and the inclination of the wall portion.

Assembly of the modular drip tray assembly 12 into the casket 10 is performed after the spring support structure 22 has been positioned within casket 10. As shown in FIG. 2, the spring support structure 22 is attached to the bed screws 16 and 18. The module 26 is then loaded into the casket such that the bottom 38 rests on top of the spring support structure 22 with the wall portion 40 extending upwardly away from the spring support structure 22. The module 26 is then moved toward the end of the casket 10 such that one of the bed screws 16 or 18 is within the concavity 48 and the rim 44 of the module 26 is abutting the inner wall of the casket 10. In this embodiment, the module 26 may be placed to abut either end of the casket 10. It is preferable, however, to place the module 26 toward the end of the casket 10 expected to be exposed to less leakage since the basin 34 of module 28 is volumetrically larger than the basin 42 of the module 26.

Next, the module 28 is inserted in a similar manner. However, concavity 46 is aligned closer to the end of the casket 10 away from the module 26. Thus, the bed screw 16 or 18 that is not within the concavity 48 will be located within the concavity 46. When the module 28 is inserted and the rim 36 is adjacent to the end of the casket 10 opposite to the end at which the module 26 was installed, the bottom 30 of the module 28 will be lying upon the spring support structure 22 and the rim 36 of the module 28 and the rim 44 of the module 26 will overlap.

The mattress 24 may then be installed, with the weight of the mattress 24 helping to maintain the modular drip tray assembly 12 in place. The modular drip tray assembly 12 is further maintained in position because the rims 44 and 36 abut the ends and sides of the casket, and motion of the modules 26 and 28 toward each other is limited by the rim 44 of the module 26 abutting the wall portion 32 of the module 28 as shown in FIG. 3B.

If desired, the wall portion 32 adjacent the rim 44 may be formed to be completely vertical or even to slant away from the rim 44 to provide additional positional stability. Specifically, because the wall portion 32 is slanted upwardly toward the module 26, it may, under certain circumstances, slide up the rim 44, creating a gap between the rim 36 and the end of the casket. By changing the orientation of the rim 36 and the wall portion 32, the opportunity for such sliding movement can be reduced.

Figure 4A:
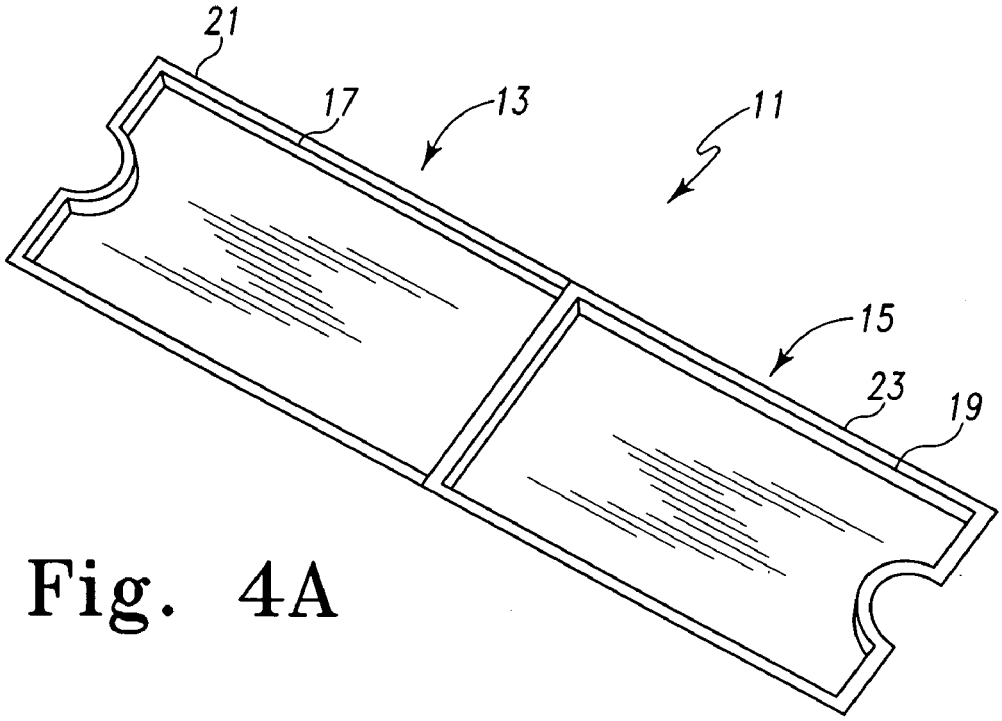
FIG. 4A shows a perspective view of an alternative embodiment of a modular drip tray assembly incorporating features of the present invention.
Figure 4B:
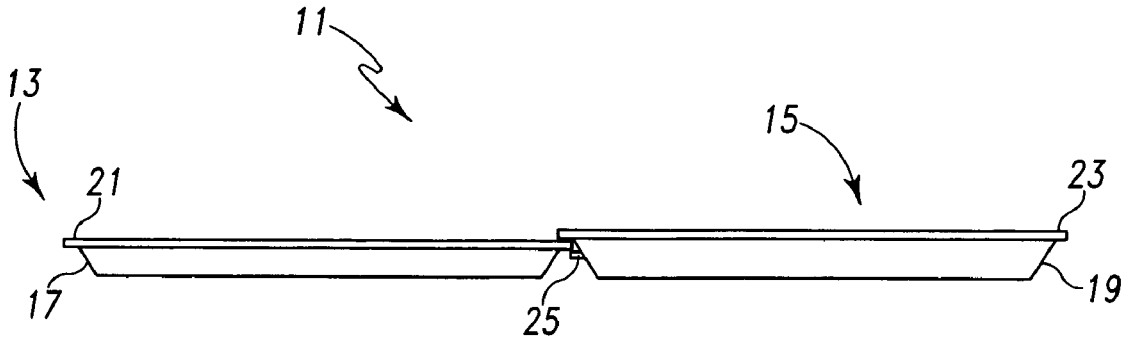
FIG. 4B shows a side elevational view of the modular drip tray assembly of FIG. 4B.

In one embodiment, a retaining member is used to prevent sliding movement between modules. A modular drip tray assembly 11, shown in FIGS. 4A and 4B, includes two modules 13 and 15. Each of the modules 13 and 15 include wall portions 17 and 19, and rims 21 and 23, respectively. The wall portion 19 includes a tab 25. The tab 25 extends outwardly from the wall portion 19 and is spaced apart from the rim 23 such that when the module 15 is installed, the tab 25 may be pushed past the rim 21. Once the tab 25 is pushed past the rim 21, the rim 21 is entrapped between the rim 23 and the tab 25. Thus, the module 15 cannot slide up onto the module 13.

It is noted that, preferably, the modules 26 and 28 are identical in design. Use of identical modules provides a number of benefits. For example, with identical modules there is no need to order, stock or match two different modules to form a modular tray assembly. Moreover, if one module is damaged, there is no additional waste of a second unmatched module. In addition, only one tooling need be developed for the entire assembly 12.

Figure 5:
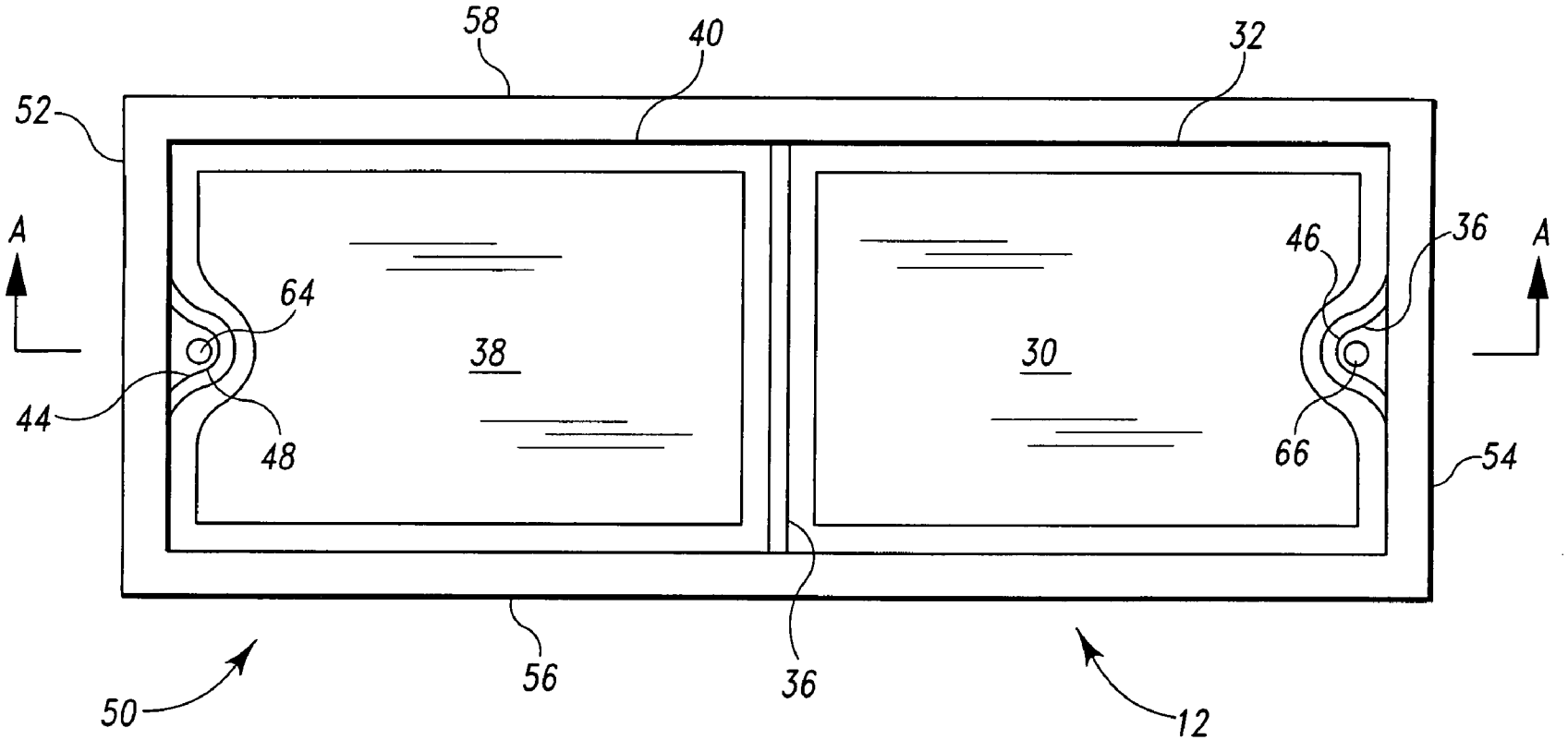
FIG. 5 shows a top elevational view of an alternative embodiment of a modular drip tray assembly incorporating features of the present invention within a casket.
Figure 6:
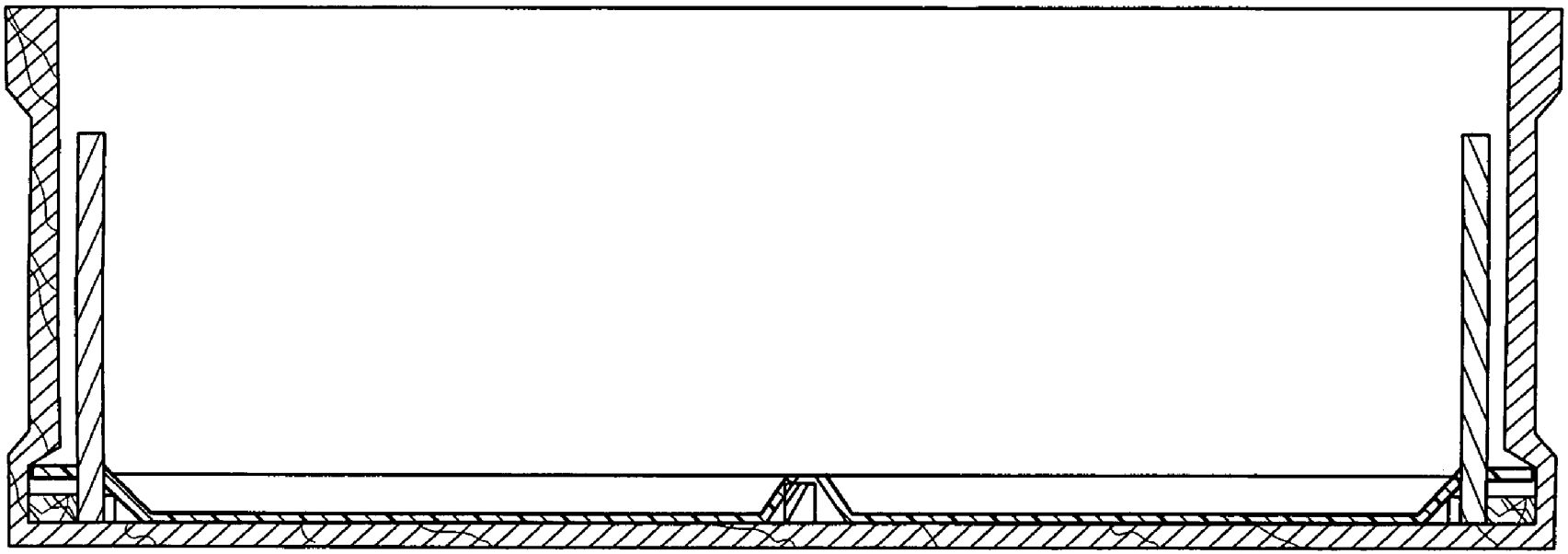
FIG. 6 shows a cross sectional view of the modular drip tray assembly and casket of FIG. 5.

Referring now to FIGS. 5 and 6, modular drip tray assembly 12 is shown assembled into a casket 50 having a configuration different from the configuration of the casket 10. The casket 50 includes two end walls 52 and 54, two side walls 56 and 58, a bottom 60, a center support bracket 62, two bed screws 64 and 66, and two flanges 68 and 70. The casket lid and mattress are not shown for ease of description. The flange 68 is generally "U" shaped in the horizontal plane, extending along the end wall 52 and about half way along both of the side walls 56 and 58. Similarly, the flange 70 is generally "U" shaped in the horizontal plane, but extends along the end wall 54 and about half way along both of the side walls 56 and 58. However, the flange 68 is located at a distance above the bottom 60 of the casket 50 less than the distance at which the flange 70 is located above the bottom 60 of the casket 50.

The concavity 48 at one end of the module 26 allows the module 26 to be placed on the bottom 60 of the casket 50 while extending from the end wall 52 at a point just below the flange 68 to a point above the center support bracket 62. Similarly, the concavity 46 of the module 28 allows the module 28 to be placed on the bottom 60 of the casket 50 while extending from the end wall 54 at a point just below the flange 70 to a point above center support bracket 62. This ensures that a maximum area of the bottom 60 is protected from any fluids, and that most, if not all, fluids will impinge upon the modular drip tray assembly 12.

Figure 7:
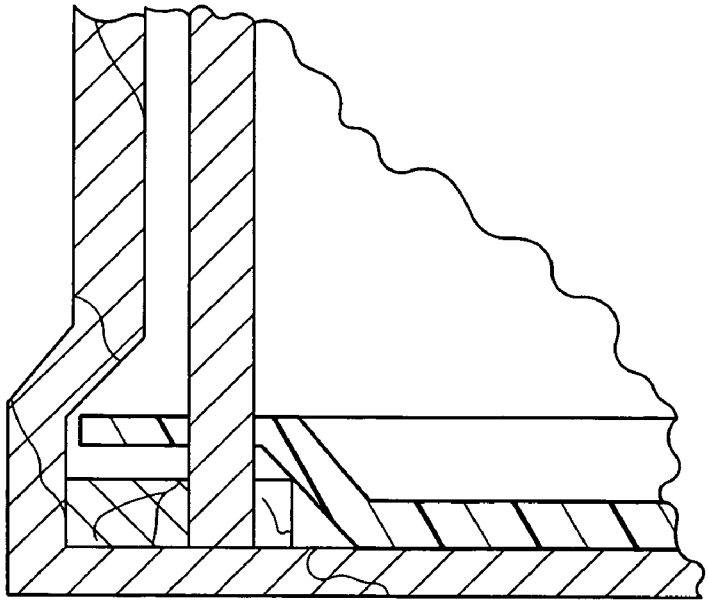
FIG. 7 shows an enlarged cross-sectional view of one end of the modular drip tray assembly and casket of FIG. 5.

As shown in FIG. 6, wherein the proportions have been exaggerated for clarity, the amount of upward and outward extension of the wall portions 32 and 40 is selected such that the modules 26 and 28 are not hindered from resting upon the bottom 60 by the center support bracket 62. The amount of upward and outward extension of the wall portions 32 and 40 is further selected such that while the modular drip tray assembly 12 is positioned on the bottom 60 of the casket 50, the rims 36 and 44 overlap at the adjacent ends of the modules 26 and 28 (above the center support bracket 62), and such that they respectively abut the end wall 52 below flange 68 and end wall 54 below flange 70, (see e.g. FIG. 7). The rims 36 and 44 are further selected so as to abut the side walls 56 and 58 at a point below the flanges 68 and 70, respectively. The overlap is designed to present a tortuous path from above the modular drip tray assembly 12, between the modules 26 and 28, to below the modular drip tray assembly 12. The tortuous path reduces the potential for leakage of fluids past the modular drip tray assembly 12. The abutment of the rims 36 and 44, combined with the flanges 68 and 70 which act as overhangs, improve the opportunity for capturing liquid that may be flowing down the side or end walls.

The positioning of the rims 36 and 44 beneath the flanges 68 and 70, respectively, also maintains the modular drip tray assembly 12 in position even if the casket 50 is jolted. This is because the periphery of the casket 50 at the flanges 68 and 70 is less than the periphery of the casket 50 below the flanges 68 and 70. Thus, flanges 68 and 70 form a restraint limiting upward movement of the modular drip tray assembly 12. Of course, restraint may be fashioned in a number of alternative ways. By way of example, but not of limitation, the modular drip tray assembly 12 may also be restrained by a plurality of protuberances located about the periphery of the end walls 52 and 54 and/or the side walls 56 and 58 in the event that a flange is not provided or if it is desired to maintain the modular drip tray assembly 12 in place at a height lower than flanges 68 and 70.

Installation of the modular drip tray assembly 12 into the casket is easily accomplished. As shown in FIG. 6, it is desired to have the rim 36 above the rim 44. Accordingly, the module 26 is inserted into the casket 50 first. The concavity 48 is aligned with the bed screw 64 with the wall portion 40 extending upwardly, away from the bottom 60 of the casket 50. The module 26 is then pushed downward and toward the bed screw 64. To ease insertion, the module is given a slight angle from side to side while inserting it into the casket. The angle is useful since the module 26 is wider than the portion of the casket 50 above the flange 68. The module 26 may also be oriented such that the end of module 26 including concavity 48 is lower than the other end of the module 26 that will overlap the module 28 for reasons set forth below.

When the module 26 nears the bottom 60 of the casket 50, the module 26 is moved toward the bed screw 64 such that the bed screw 64 is positioned within the concavity 48. At about the same time, the lowermost portion of the rim 44 is positioned underneath the flange 68 and against the end wall 52. The module 26 is then pushed in the downward direction until it becomes level. The module 26 will flex slightly to allow the rim 44 to slide past and below the flange 69 along the side walls 56 and 58. After the rim 44 has cleared the flange 68, the module 26 will return to its original shape, and will be positioned on the bottom 60 of the casket 50. If the module 26 is not abutting the end wall 52, the module 26 is moved toward the end wall 52 such that the rim 44 abuts the end wall 52 beneath the flange 68.

In a similar fashion, the module 28 is installed. Specifically, the concavity 46 is aligned with the bed screw 66 with the wall portion 32 extending upwardly, away from the bottom 60 of the casket 50. The module 28 is then pushed downward and toward the bed screw 66. To ease insertion, the module is given a slight angle from side to side while inserting it into the casket. The angle is useful since the module 28 is wider than the portion of the casket 50 above the flange 70. The module 28 may also be oriented such that the end of the module 28 including concavity 46 is lower than the other end of the module 28 that will overlap the module 26.

When the module 28 nears the bottom 60 of the casket 50, the module 28 is moved toward the bed screw 66 such that the bed screw 66 is positioned within the concavity 46. At about the same time, the lowermost portion of the rim 36 is positioned underneath the flange 70 and against the end wall 54. The module 28 is then pushed in the downward direction until it becomes level. The module 28 will flex slightly to allow the rim 36 to slide past and below the flange 70 along the side walls 56 and 58. After the rim 36 has cleared the flange 70, the module 28 will return to its original shape, and will be positioned on the bottom 60 of the casket 50. If the module 28 is not abutting the end wall 54, the module 28 is moved toward the end wall 54 such that the rim 36 abuts the end wall 54 beneath the flange 70. At this point, rim 36 will overlap rim 44 as shown in FIG. 6.

Figure 8:
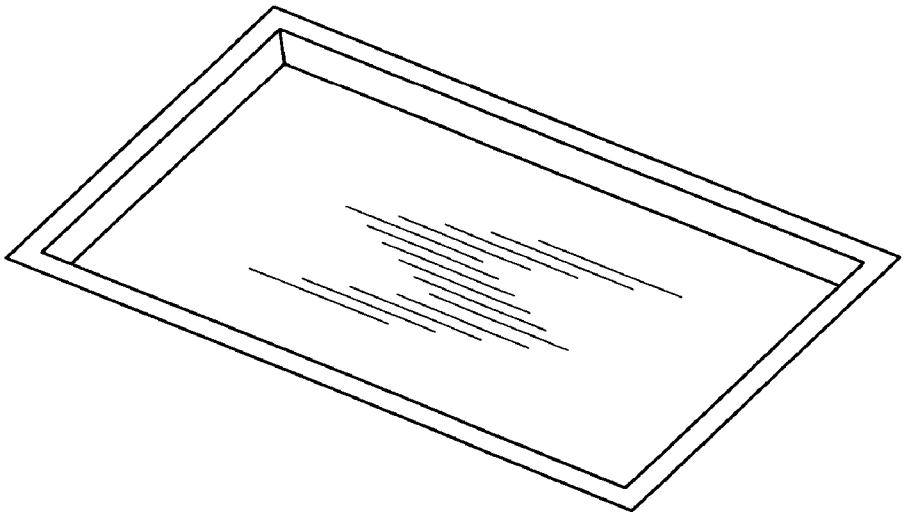
FIG. 8 shows a perspective elevational view of a drip tray module that may be used with the modular drip tray assembly of FIG. 5.

Referring now to FIG. 8, an alternative embodiment of a module that incorporates features of the present invention is shown. The module 72 includes a bottom 74, a wall portion 76 and a rim 78. The wall portion 76 extends upwardly and outwardly from the bottom 74 and extends completely around the periphery of the module 72. Rim 106 extends outwardly from the wall portion 76. The module 72 is configured to be used cooperatively with two other modules, such as the modules 26 and 28. The module 72 may be placed between the modules 26 and 28 to provide additional length to the modular drip tray assembly 12. When so placed, the rim 78 of the module 72 may be placed to overlap with the rim 36 of the module 28 as well as with the rim 44 of the module 26. Thus, two overlap regions are formed. In one embodiment, the adjacent modules are identical, and the wall portion 76 of the module 72 is slightly taller than the wall portions of the adjacent modules.

Installation of embodiments having additional modules, wherein all of the modules have a wall portion of generally the same height is preferably accomplished by first inserting the end modules, and then inserting the central module(s). Installation is thus similar to the two module installations described above, except that the rims of the end modules will not overlap each other, and the additional module is inserted. Upon insertion of the final module, all adjacent rims will be overlapping. For installation of embodiments having additional modules, wherein the modules have wall portions of different heights, it is generally preferred to install the modules with shorter wall portion heights first.

Figure 9:
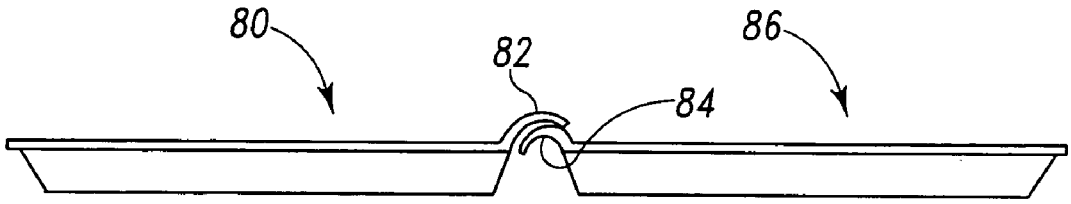
FIG. 9 shows a side elevational view of an alternative embodiment of a modular drip tray assembly incorporating features of the present invention.

The invention described above may be practiced in a number of alternative ways. By way of example, but not of limitation, the adjacent rims of two modules need not be flat. Referring to FIG. 9, a module 80 includes a curved rim 82. A curved rim 84 of a module 86 is shown overlapped with the rim 82.

Figure 10:
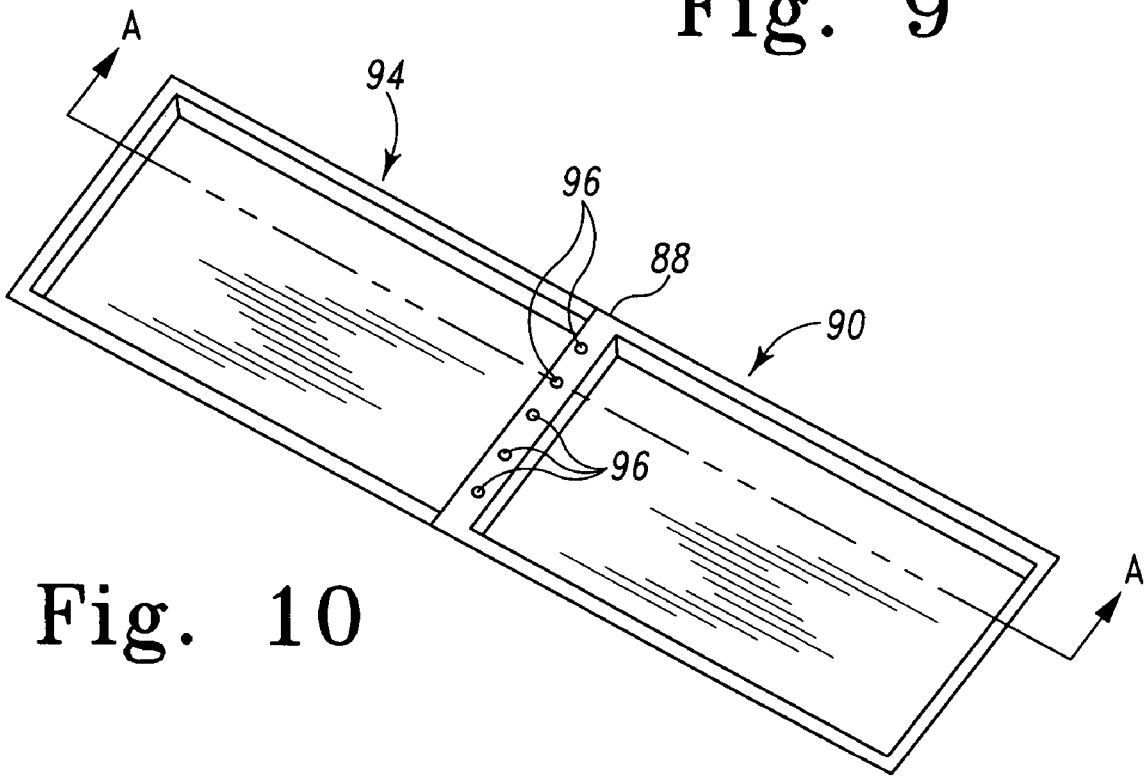
FIG. 10 shows a perspective elevational view of an alternative embodiment of a modular drip tray assembly incorporating features of the present invention.
Figure 11:
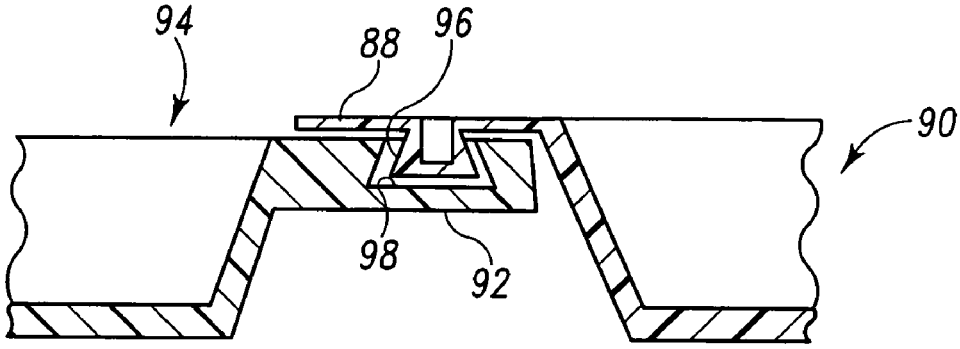
FIG. 11 shows a partial cross sectional view of the modular drip tray assembly of FIG. 10.

Another example is shown in FIGS. 10 and 11. The rim 88 of the module 90 overlaps the rim 92 of the module 94. The rim 88 includes several protuberances 96. The rim 92 includes a number of corresponding wells 98 (only one is shown). Each protuberance 96 is inserted into a well 98. Engaging adjacent modules in such a manner has the benefit of ensuring that no gap is created between the modules as the casket is moved. Any such gap could lead to undesired leakage. Additionally, when using properly sized modules, engagement verifies that the modules have been properly installed since misalignment will make engagement very difficult for most embodiments. The protuberances may be sized with a head area slightly larger than the opening to the wells to create a frictional engagement between the protuberance and the well to further protect against accidental separation of the modules. Alternatively, the protuberance may be designed to simply protrude into the well without any contact. Contact in this embodiment is initiated by relative movement between the modules. In yet another embodiment, the well is replaced by an opening in the module into which the protuberance is inserted.

Those of ordinary skill in the art will appreciate that adjacent modules may be engaged in a number of alternative ways. The engagement may be at one or more points of engagement, or with a single engaging member that extends along the entire sides of adjacent modules. These alternatives and others are within the scope of the present invention.

Figure 12:
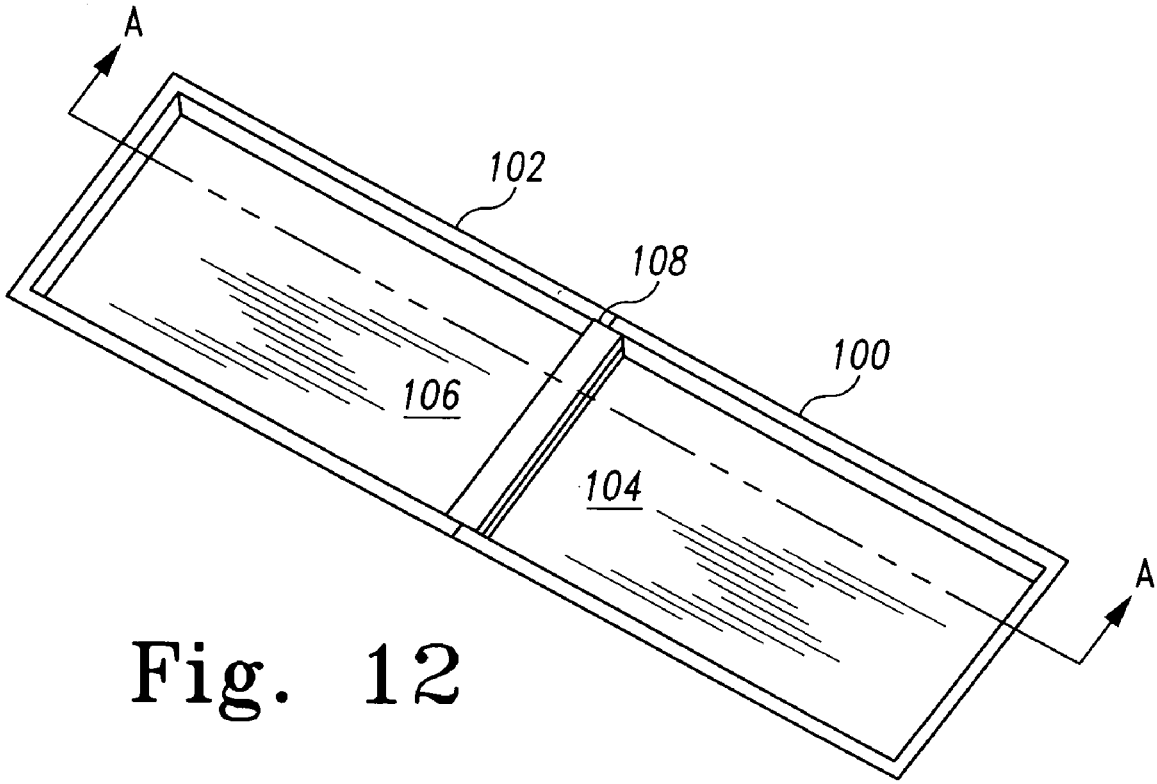
FIG. 12 shows a perspective elevational view of an alternative embodiment of a modular drip tray assembly incorporating features of the present invention that includes a clip.
Figure 13:
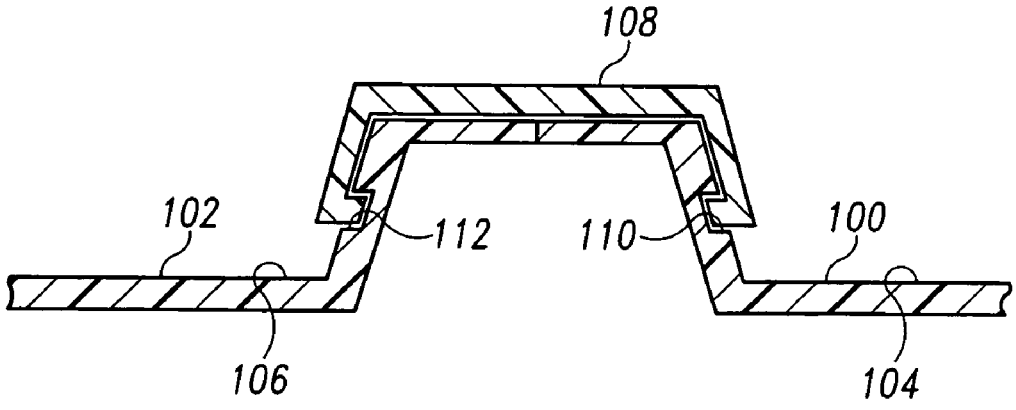
FIG. 13 shows a partial cross sectional view of the modular drip tray assembly of FIG. 12.

In another embodiment of the present invention, adjacent modules may, but need not overlap. Referring to FIG. 12, a module 100 and a module 102 include basins 104 and 106, respectively, and are joined by a clip 108. As shown in FIG. 13, the modules 100 and 102 are formed with notches 110 and 112 respectively. The clip 108, which in this embodiment is made of high density polyethylene, engages the notches 110 and 112. The clip 108 in this embodiment is sized to extend across the entire width of the basins 104 and 106 when the assembly is installed into a casket. The clip 108 thus acts as an overlap member and provides an overlap region spanning a portion of the modules 100 and 102.

Figure 14:
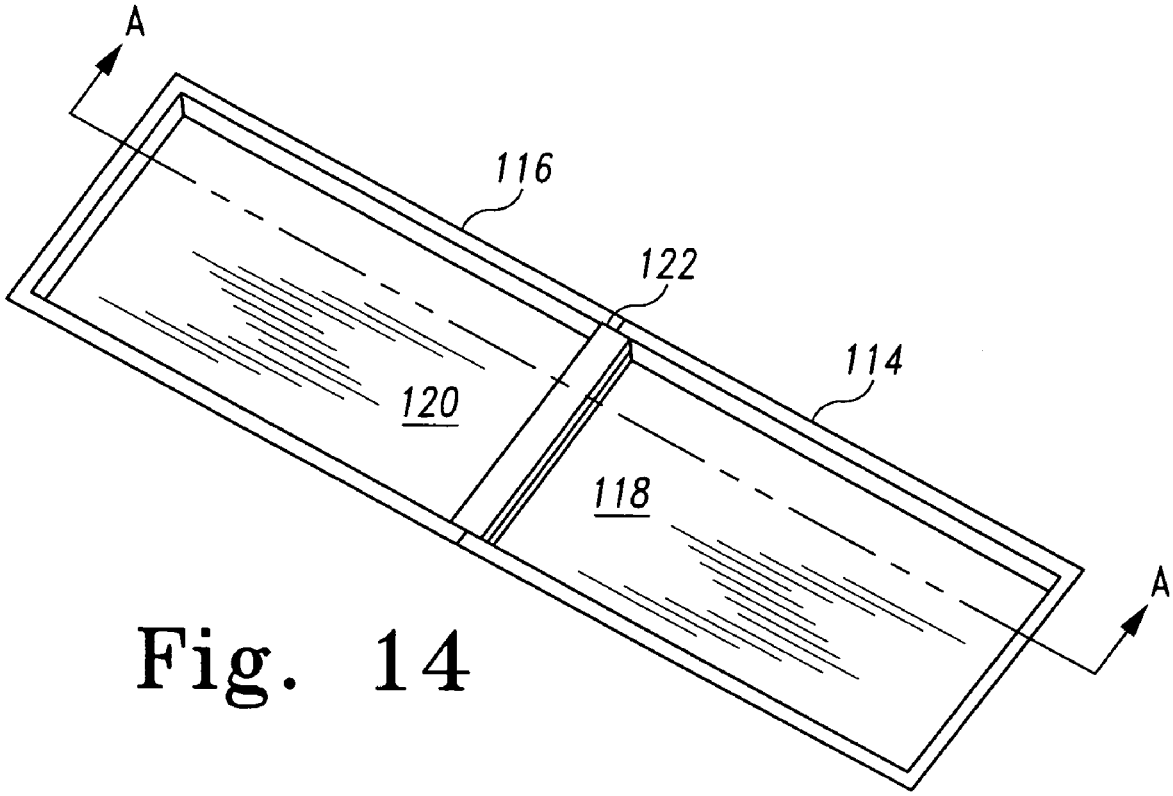
FIG. 14 shows a perspective elevational view of an alternative embodiment of a modular drip tray assembly incorporating features of the present invention that includes a clip.
Figure 15:
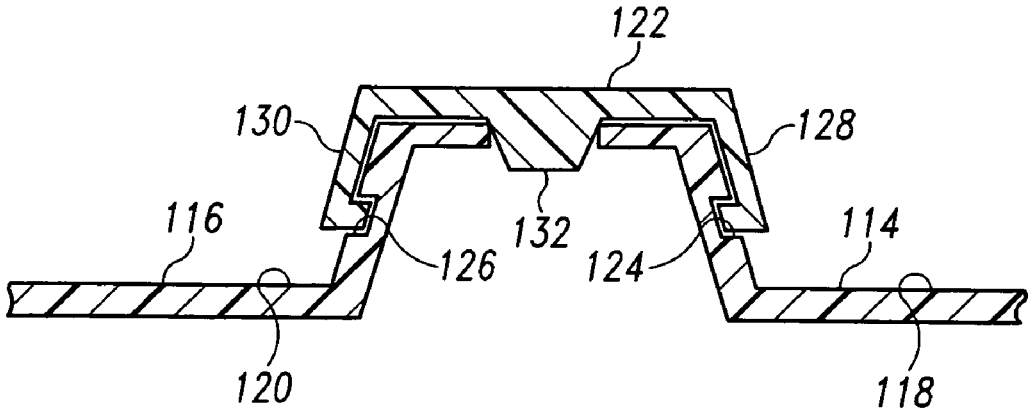
FIG. 15 shows a partial cross sectional view of the modular drip tray assembly of FIG. 14.

Referring to FIGS. 14 and 15, a module 114 and a module 116 include basins 118 and 120, respectively, and are joined by a clip 122. As shown in FIG. 15, the modules 114 and 116 are formed with notches 124 and 126 respectively. The clip 122 includes arms 128 and 130 that engage the notches 124 and 126 in a manner similar to that of the clip 108 shown in FIGS. 12 and 13. However, the clip. 122 also includes a spacer bar 132. The spacer bar 132 is sized to ensure that the modules 114 and 116 abut the ends of a casket when installed, while the arms 130 and 132 provide stability to the final assembly.

It will be appreciated that the above embodiments are merely exemplary, and that those of ordinary skill in the art may readily devise their own implementations and adaptations that incorporate the principles of the present invention and fall within the spirit and scope thereof. By way of example, but not of limitation, the clips shown in FIGS. 12–15 may be modified to extend completely across the modules, or a plurality of clips may be provided to be used to join two modules. Additionally, the clips may be made from a material different than the material used to form the modules. The salient consideration is that sufficient resiliency exists between the clip and the modules to allow the clip to be snapped into a position wherein both modules are engaged by the clip.

Moreover, many detailed features have been disclosed herein that provide additional advantages beyond those of the present invention, or indeed enhance the present invention. It will be appreciated that many of the advantages of the present invention may be obtained without such detailed features. Accordingly, the claims defined below are not intended to incorporate portions or details of the disclosed embodiments that are not expressly recited in the claims. The principles of the present invention have widespread applications, and may be incorporated into any number of modular drip tray assembly designs by those of ordinary skill in the art. In addition, it will be appreciated that while embodiments described herein employ two modules, other embodiments may employ three or more modules.

We claim:

1. A method of installing a drip tray in a casket comprising the steps of, providing a first modular tray having a first rim, and a second modular tray having a second rim, the first and second modular tray defining the drip tray, installing a first modular tray in a casket, and installing the second modular tray in the casket such that the first rim and the second rim overlap.

2. The method of claim 1, wherein the step of providing a first and a second modular tray comprises the step of providing the first modular tray having a first rim, and the second modular tray having a second rim engageable with the first rim, and wherein the step of installing the second modular tray comprises the step of engaging the first rim with the second rim.

3. The method of claim 1, wherein the step of providing a first and a second modular tray comprises the step of providing the first modular tray of a generally rectangular shape having a first, a second, a third, and a fourth side, the first rim operably connected to the first side and a first guide operably connected to the second side of the first modular tray, and wherein the step of installing the first modular tray comprises the step of guiding the installation of the first modular tray with the first guide.

4. The method of claim 3, wherein the step of guiding the installation comprises the step of inserting a flange into a receiving slot of the casket.

5. The method of claim 1, wherein the first rim is integrally formed with the first tray and the second rim is integrally formed with the second tray.

6. The method of claim 1, wherein:

the first rim comprises a substantially horizontal section and at least one protuberance extending from the substantially horizontal section; and the second rim comprises a substantially horizontal section having at least one opening for receiving the at least one protuberance.

7. The method of claim 6, wherein the second rim further comprises at least one well located beneath the at least one opening and sized such the at least one protuberance fits in the at least one well when the protuberance is inserted into the at least one opening.

8. The method of claim 1, wherein the first modular tray further comprises a tab located beneath the first rim and spaced apart from the first rim at a distance, and wherein the step of installing the second modular tray in the casket such that the first rim and the second rim overlap further comprises installing the second modular tray such that the second rim is positioned between the first rim and the tab.

9. A method of installing a drip tray in a casket comprising the steps of, a) providing a first modular tray and a second modular tray, the first and second modular tray defining the drip tray, b) installing the first modular tray in the casket;

c) installing the second modular tray in the casket adjacent to the first modular tray; and d) forming an overlap region within the casket using at least one overlap member, the overlap region extending at least in part between the first and the second trays.

10. The method of claim 9, wherein the at least one overlap member comprises a first rim integrally formed with the first modular tray.

11. The method of claim 10, wherein the at least one overlap member further comprises a second rim integrally formed with the second tray, such that the first rim and the second rim overlap.

12. The method of claim 9, wherein step d) further comprises installing the overlap member that spans a distance between the first tray and the second tray.

13. The method of claim 12, wherein the overlap member comprises a clip.

14. A casket assembly, comprising:

a casket; a drip tray including a first modular tray and a second modular tray;

the first modular tray having a first rim installed within the casket; and the second modular tray having a second rim installed within the casket, wherein the first rim and the second rim overlap.

15. The casket assembly of claim 14, wherein the first rim engages the second rim.

16. The casket assembly of claim 14, wherein the first modular tray is of a generally rectangular shape having a first, a second, a third, and a fourth side, the first rim operably connected to the first side, the first modular tray further comprising, a first guide operably connected to the second side of the first modular tray, the first guide designed to interact with the casket so as to assist in proper installation of the first modular tray in the casket.

17. The casket assembly of claim 16, wherein the first guide comprises a flange, and the casket comprises a slot configured to receive the flange.

18. The casket assembly of claim 14, wherein the first modular tray comprises, a bottom operably connected to the first rim, the bottom having at least one upstanding rib forming a plurality of discrete compartments for the retention of fluids.

19. The casket assembly of claim 18, wherein the at least one upstanding rib comprises a plurality of intersecting ribs.

20. The casket assembly of claim 14, wherein the second modular tray is substantially identical to the first modular tray.

* * * * *